US005318342A

United States Patent [19]

Hale

[11] Patent Number: 5,318,342

[45] Date of Patent: Jun. 7, 1994

[54] BACK PACK FOLDING CHAIR

[76] Inventor: Clyde L. Hale, 9961 San Juan St., Spring Valley, Calif. 91977

[21] Appl. No.: 853,689

[22] Filed: Mar. 19, 1992

[51] Int. Cl.[5] ..... A47C 13/00

[52] U.S. Cl. ..... 297/129; 297/17

[58] Field of Search ..... 297/17, 129, 118, 191, 297/183; 224/155

[56] References Cited

U.S. PATENT DOCUMENTS

| | | | |
|---|---|---|---|
| 4,387,924 | 6/1983 | Fernandez | 224/155 X |
| 4,392,598 | 7/1983 | Dixon | 224/155 |
| 4,582,165 | 4/1986 | Latini | 224/155 X |
| 4,676,548 | 6/1987 | Bradbury | 297/129 |
| 4,947,498 | 8/1990 | Van Boxtel | 224/155 X |
| 4,955,517 | 9/1990 | Maresca | 297/129 X |
| 5,016,792 | 5/1991 | Jay | 297/129 X |
| 5,139,308 | 8/1992 | Ziman | 297/129 X |

*Primary Examiner*—Jose V. Chen

*Attorney, Agent, or Firm*—Knobbe, Martens, Olson & Bear

[57] ABSTRACT

A back pack folding chair is provided by three simple, U-shaped frames and has one of the panels of a back pack acting as the fabric seat for the folding chair. Back pack side pockets conveniently hang from the arms of the chair. The three U-shaped frames form a seat frame, arm frame and a back frame hinged together to allow the chair to fold into a neat compact package. One of the side pockets attached to the arm frame is removable for use as a waist or "fanny" pack. Shoulder straps and a belt allow the back pack folding chair to be easily carried on the shoulders.

7 Claims, 3 Drawing Sheets

Fig. 1.

BACK PACK FOLDING CHAIR

FIELD OF THE INVENTION

This invention relates to camping equipment, such as back packs and folding chairs more particularly relates a back pack integrated into the construction of a folding chair.

BACKGROUND OF THE INVENTION

Back Packs for hiking and camping as well as folding chairs for use outdoors are known in the art. The need to transport some type of chair when backpacking and camping has resulted in attempts to produce folding chairs that have carryalls attached to them. However, the attempts at solving these problems with carryall folding chairs have produced complicated and marginally useful structures that are woefully inadequate for use as a carryall.

One such device described in U.S. Pat. No. 4,577,901 is a folding transportable utility chair that has a carryall attached to one of the panels forming the back panel and has a pair of carrying straps for carrying the transportable chair on the shoulders. Another folding chair is shown in U.S. Pat. No. 4,489,866 which is in the form of a back pack attached to the back supporting part of a chair having shoulder straps for carrying the back pack and chair. Other examples of cumbersome and complicated back pack folding chair combinations are shown in U.S. Pat. Nos. 4,676,548; 4,487,435; 4,720,029, 3,266,686 and 4,773,574.

It is therefore one object of the present invention to provide a back pack folding chair combination which is simple in construction and easy to use.

Yet another object of the present invention is to provide a back pack folding chair combination in which the back pack is incorporated into the seat of the chair with pockets secured to the arm rails.

BRIEF DESCRIPTION OF THE INVENTION

The purpose of the present invention is to provide a back pack incorporated into a folding chair that is simple in construction and easy to use.

The back pack folding chair of the present invention achieves the purposes described above by providing a simple, three U-shaped frame construction having one of the panels of the back pack acting as the fabric seat for the folding chair. A seat frame is formed in a U-shape having side rails and an angular portion forming the rear legs of the chair. A second arm frame forms the arms of the chair with an angle portion forming the front support legs. A third U-shaped frame forms the back of the chair with a fabric panel stretched across the vertical rails of the U-shaped back frame to provide a seat back.

The portion of the back pack forming the fabric of the seat includes a number of pockets for carrying various articles. Additional carryall pockets are provided along the arm rails of the chair which easily hang downward along the sides of the chair when unfolded. Thus the back pack forms the seat panel of the chair with the main storage pocket being on the bottom of the seat panel and the side pockets attached to the arm rails.

Another unique feature of the invention is the ability to use one of the side pockets attached to the arm rail as a waist or "fanny" pack. This is provided by constructing the side pocket to be removable from the side rail and incorporating a belt for fastening the pocket around the waist when it is detached from the frame of the chair.

The above and other novel features and advantages of the invention will be more fully understood from the following detailed description and accompanying drawings in which:

DETAILED DESCRIPTION OF THE INVENTION

Figure 1:
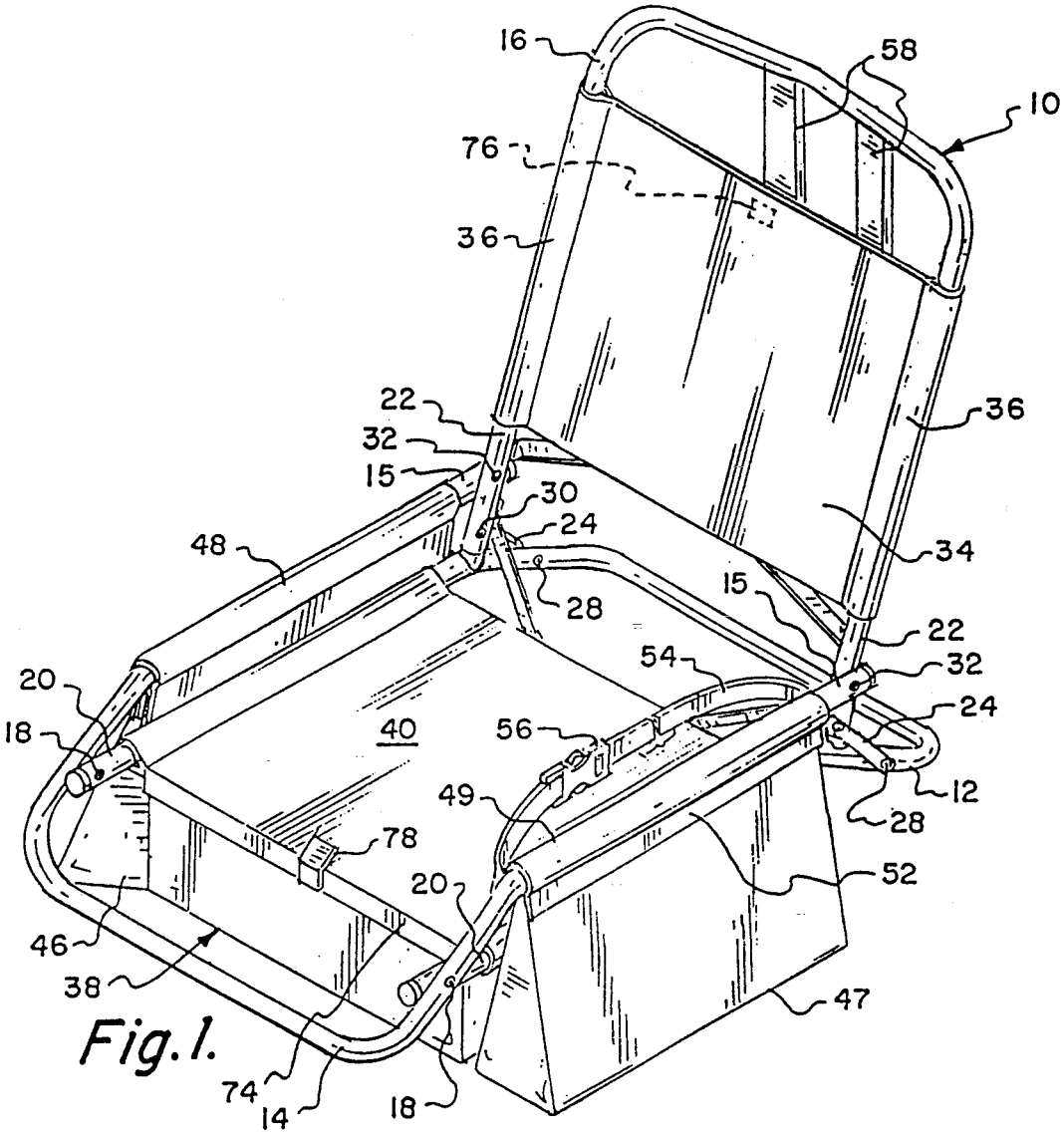
FIG. 1 is a perspective view of a back pack incorporated into a folding chair according to the invention.
Figure 4:
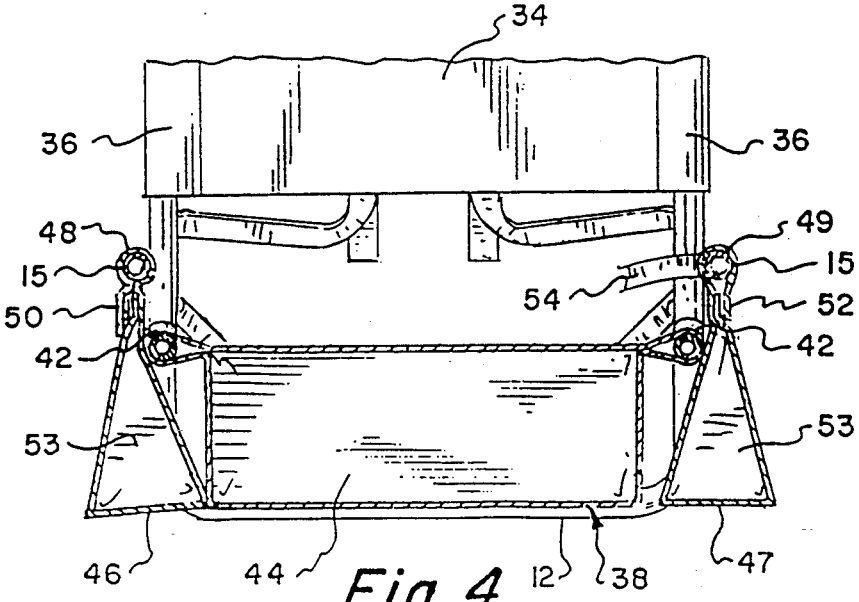
FIG. 4 is a sectional view taken at 4—4 of FIG. 3.
Figure 3:
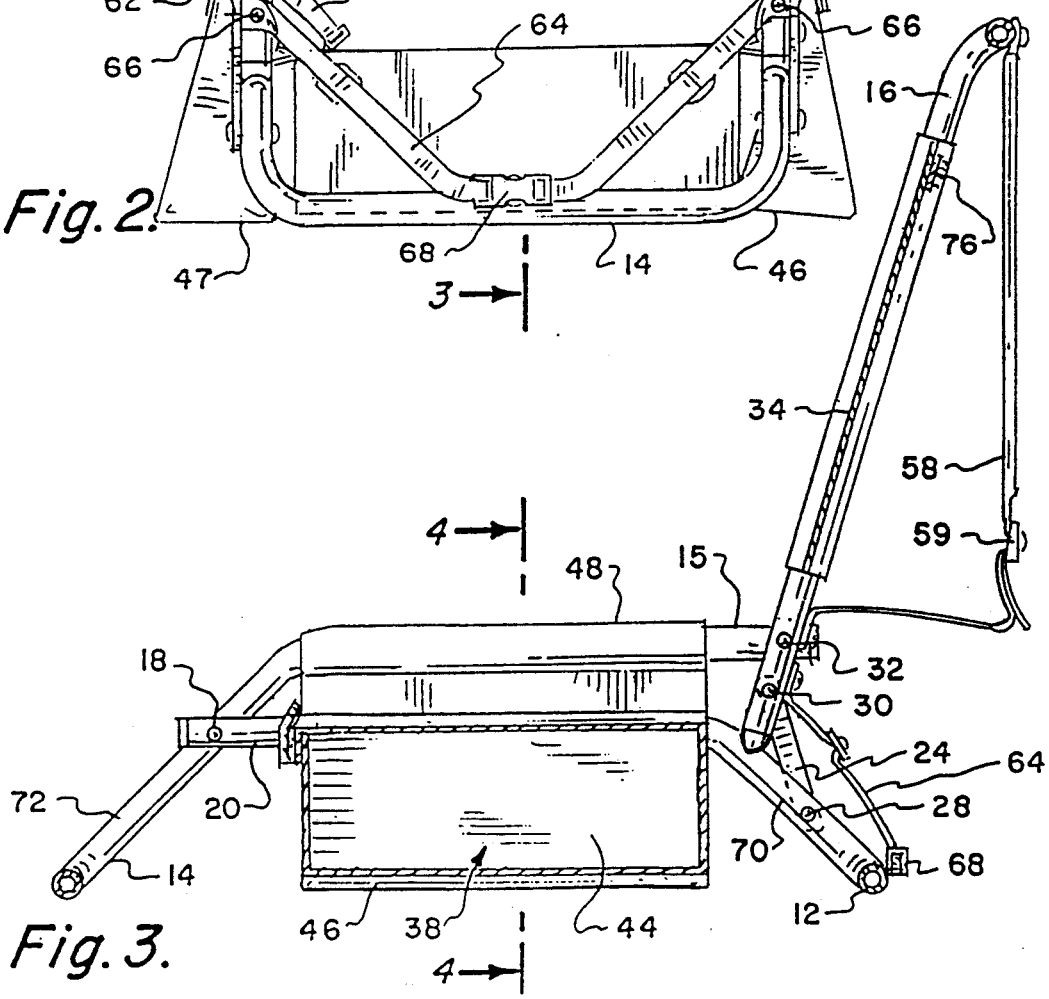
FIG. 3 is a sectional view taken at 3—3 of FIG. 2.

A back pack incorporated into a folding chair is shown 16 generally in the perspective view of FIG. 1. The folding chair 10 is comprised of three simple frames; a seat frame 12; an arm frame 14; and a back frame 16. Each frame 12, 14, 16 is preferably made of a hollow tubular metal, as illustrated in FIGS. 3 and 4. The seat frame 12 is hingedly connected to the arm frame 14 by pins 18 at the end of side rails 20. Seat frame 12 is also hingedly connected to the ends of back frames upright rails 22 by bars 24 secured by pins or rivets 28 and 30. Arm frame 14 is also hingedly connected to the upright rails 22 by pins 32. This simple three frame construction and hinge connections at 18, 28, 30 and 32 allow the chair to be easily folded in a compact position for transport.

The back 34 of folding chair 10 is formed of a sheet of fabric, stitched at each end to form tubes 36 that are easily slipped over the upright rails 22 of the seat back 16.

Back pack 38 is attached to folding chair 10 by incorporating one panel of the back pack as the seat portion or panel 40. Seat panel 40 on one side of back pack 38 has a section forming tubular portions 42 which easily slip over side rails 20 of seat frame 12. Back pack 38 thus forms seat panel 40 as well as providing a large pocket 44 for storing articles as will be described in greater detail hereinafter.

Side pockets 46 of back pack 38 are supported by arm rails 15 of arm frame 14. Side pockets 46 are triangular shaped and tapered down to sections that form tubes 48 that easily slip on arm rails 15 of arm frame 14. Flaps 50 traversing the outside surface of pockets 46 are sealed by Velcro fasteners and provide access to interior pocket 39 for storage of articles. Side pockets 46 are stitched to form tubes 48 for being securely retained on arm rails 15.

In an optional by preferred construction of the invention, one or both of side pockets 46 will be removable for use around the waist as a "fanny pack" if desired. The fanny pack 47 is secured to arm rail 15 by wrapping panel 52 around the arm rail forming a tubular portion 49 and is then sealed by velcro mounted on the side panel of the fanny pack 47 and the underside of flap 52. A waist belt 54 having a buckle 56 passes beneath flap 52 and is securely stitched to the fabric. To use side pocket 47 as a fanny pack flap 52 is detached from the side of pocket 47 allowing it to be easily removed from arm rail 15. The pocket can then be secured to the waist by wrapping the belt 54 around the waist and securing buckle 56.

Figure 6:
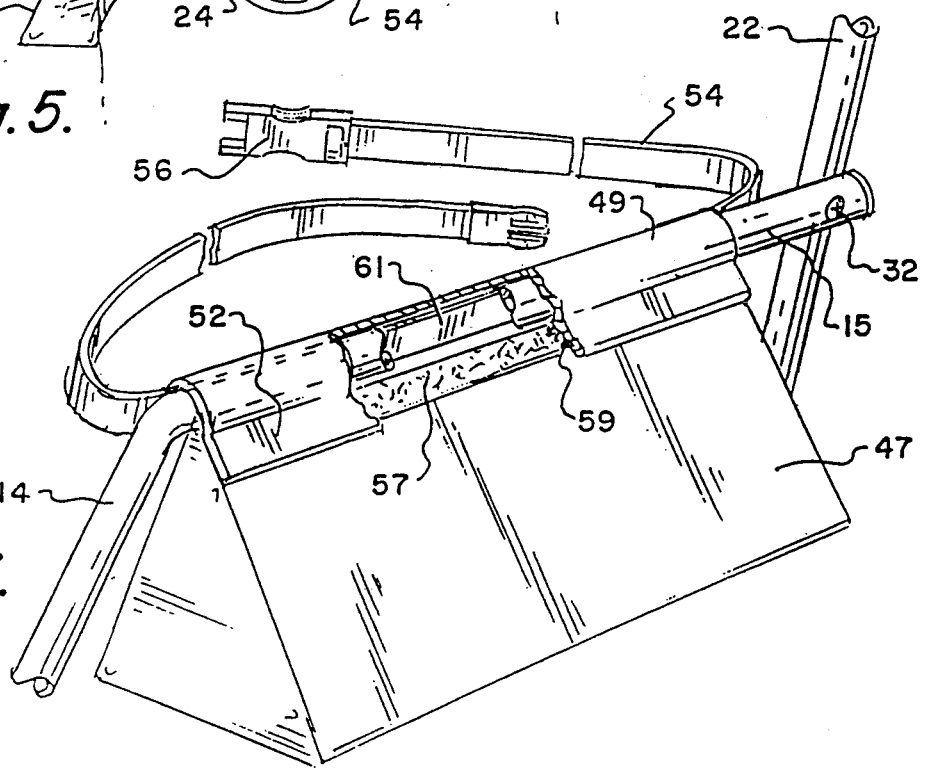
FIG. 6 is a partial sectional view illustrating the removable side pocket in more detail.

The fanny pack is shown in greater detail in FIG. 6. The fanny pack or side pocket 47 is constructed in a triangular shape, the same as the opposite side pocket but is not fastened permanently to arm rail 15. The fanny pack is constructed with a flap 52 that wraps around the arm rail 15 and is fastened by velcro strips 57 on the pocket and a second velcro strip 59 on the inside edge of flap 2. Belt 54 passes beneath flap 52 and is stitched along the surface at 61. When not in use buckle 56 is closed and tightened and belt 54 just lies along fanny pack 47 inside the arm of the folding chair 10.

Figure 5:
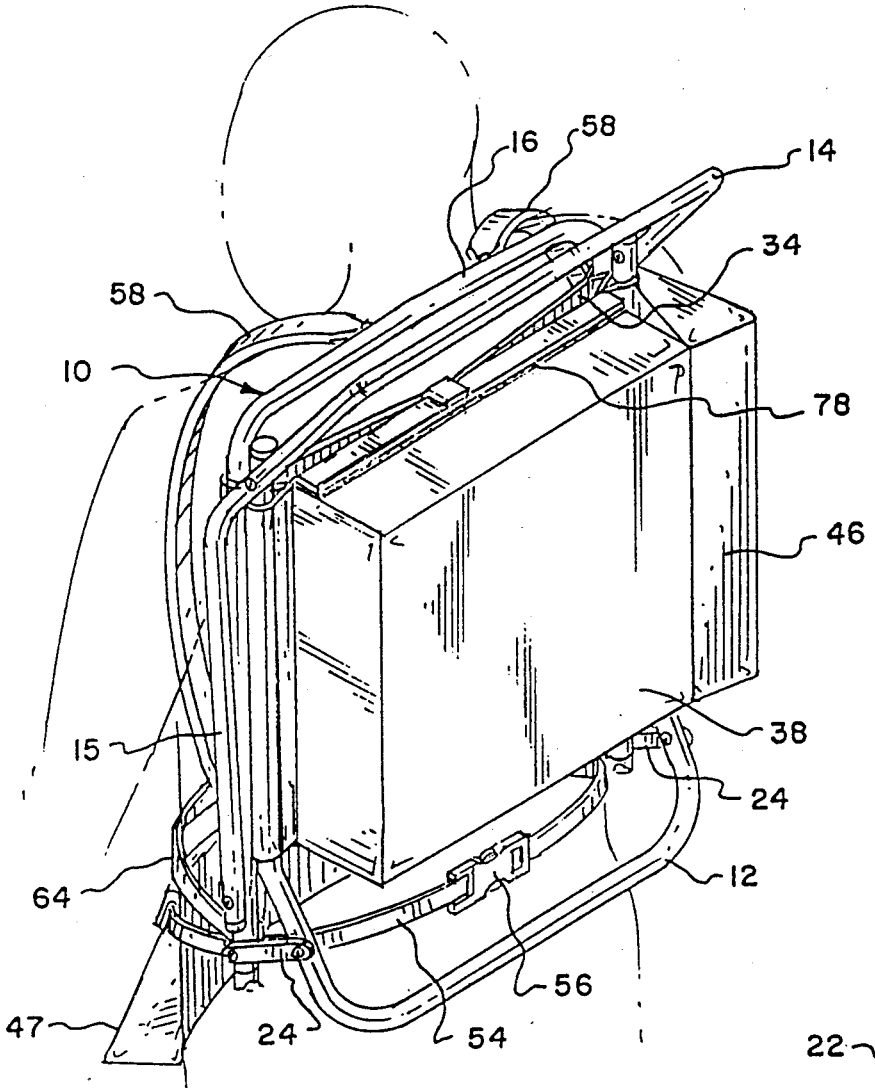
FIG. 5 is a perspective view illustrating the use of the back pack having the folding chair incorporated therein and the use of the detachable waste pack.

To use the fanny pack, flap 52 is opened by separating velcro strips 57 and 59 allowing the fanny pack 47 to be detached from the arm of the chair. Belt 54 may now be wrapped around the waist as shown in FIG. 5 and worn as a fanny pack.

Figure 2:
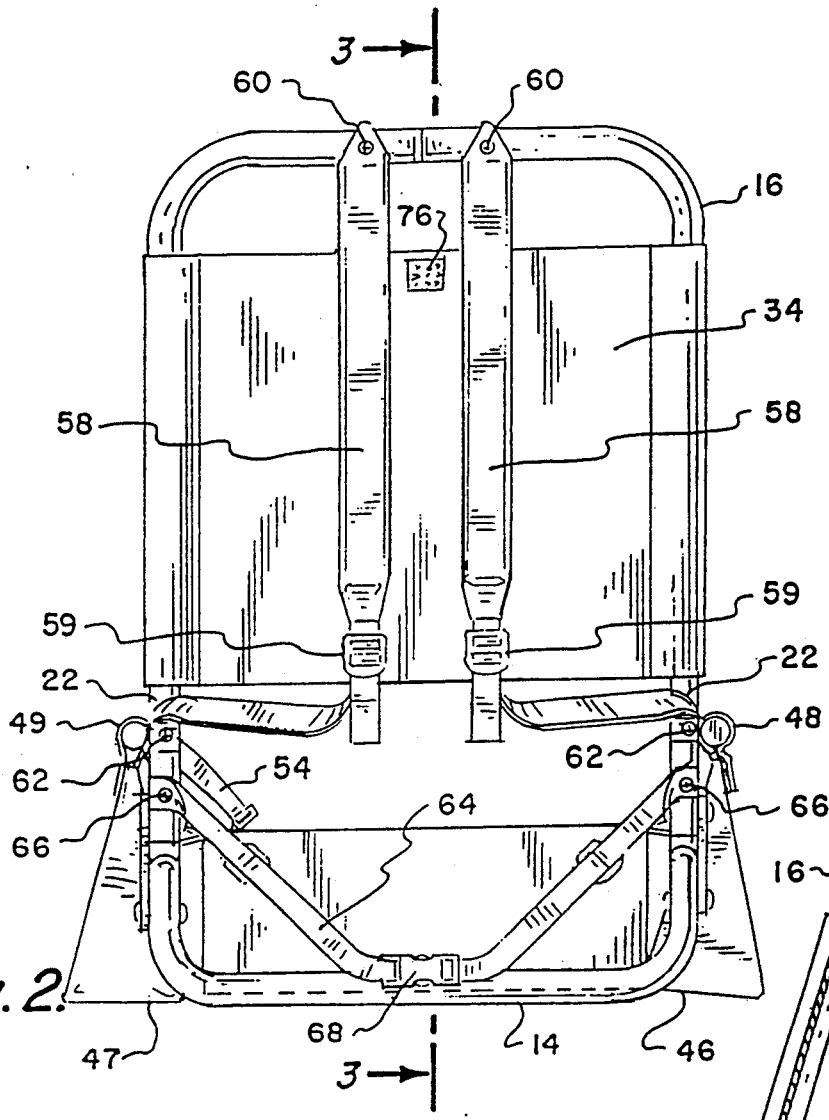
FIG. 2 is a rear view of the back pack folding chair combination

Shoulder straps and belt for carrying the back pack folding chair are shown in FIG. 2. Shoulder straps 58 are secured to seat back frame 16 by rivets or fasteners 60 at the upper cross bar and 62 at the lower end of the seat back upright rails 22. A belt 64 is also secured to upright rails 22 by fasteners 66. Belt 64 has a quick release buckle 68 for fastening the belt around the waist when the back pack folding chair is being carried by the shoulders.

The construction and arrangement of the seat frame 12, arm frame 14, and back frame 16 can be seen more clearly in the sectional view of FIG. 3. Seat frame is comprised of side rails 20 that terminate in an angled portion 70 that forms the rear support or legs. Arm frame 14 has arm rails 15 extending forward and angling downward to form front support legs 72. The length of front and rear leg supports 70 and 72 should be sufficient to allow clearance for back pack 38 when the chair is unfolded as illustrated in FIG. 1.

Access to back pack 38 is provided by a velcro secured flap 74 across the width of the back pack. This construction allows easy access to the pocket 44 of back pack 38 from the front when the chair is unfolded. A person seated in the chair can easily reach into the back pack to retrieve an article.

Chair 10 is secured in a folded position by velcro loop material 76 on the rear of seat back panel 34 that mates with Velcro tab 78 (FIG. 1) on the front of back pack 38. Thus when seat frame 12 and arm frame 14 fold up against back frame 16, Velcro tab 78 mates with Velcro material 76 on the back of back panel 34 securing the folding chair in a collapsed position as shown in FIG. 5. FIG. 5 illustrates the back pack folding chair in its folded position for carrying as a back pack. As shown fanny pack 47 has been removed from arm rail 15 of folding chair 10 and secured to the waist by belt 54. Tab 78 secures the chair 10 in a folded position by attaching to back 34. Shoulder straps 58 fit over the shoulders and are adjusted at buckles 59 (FIG. 2). Thus the back pack folding chair is easily carried on the shoulders.

To remove and set up the chair shoulder straps 58 are loosened and waist belt 64 released. Tab 78 is released from seat back 34 allowing the back frame 16 to pivot away from seat frame 12 and arm frame 14 into the position as shown in FIG. 1. The back pack has now been easily and quickly converted into a comfortable utility transportable chair.

Thus there has been described a back pack incorporated into a folding chair that is very simple in construction and easy to use. The chair is comprised of three simple U-shaped frames connected and hinged to fold and unfold easily. The back pack is incorporated to provide a large storage pocket with one panel of the back pack acting as the seat of the folding chair. The side pockets of the back pack are secured to arm rails on the arm frame of the chair.

This invention is not to be limited by the embodiment shown in the drawings and described in the description which is given by way of example and not of limitation, but only in accordance with the scope of the appended claims.

What is claimed is:

1. A back pack folding chair, comprising:

a seat frame having sides rails and supporting a seat member having an occupant engaging surface on which a user sits;

a pair of arms;

front end rear legs each formed as an extension of either said seat frame or said arms, said legs extending below said seat frame be a first distance and supporting said seat frame, seat member, and user;

a back frame supported from said legs;

a back pack having a large main storage compartment, said back pack supported beneath said side rails of said seat frame, a portion of said back pack forming said occupant engaging surface said back pack having a thickness dimension which is less than said first distance so that said user is not supported by said back pack;

hinge means hingedly connecting said seat frame, arms and back frame so that said seat frame and arms can fold toward said back frame into a flat transportable package; and shoulder straps for carrying said back pack and folding chair when in a folded position.

2. The back pack folding chair of claim 1 wherein said back pack includes tubular portions slidably fitting said seat frame.

3. The back pack folding chair of claim 1, where said seat frame, back frame, and arms are made of a hollow tubular material.

4. The back pack folding chair of claim 1, including at least one side pocket attachable to one of said arms.

5. The back pack folding chair of claim 4, wherein said side pocket includes a belt for fastening said side pocket for carrying at the waist.

6. The back pack folding chair of claim 1, wherein said back pack has a latched opening along the side forming the front of said folding chair set member whereby an interim portion of said back pack is accessible when said chair is in use.

7. The back pack folding chair of claim 1, further including a belt attached to a lower portion of said back frame for securing said back pack folding chair at the waist.

* * * * *